US011485551B2

(12) United States Patent
Weishaar et al.

(10) Patent No.: US 11,485,551 B2
(45) Date of Patent: Nov. 1, 2022

(54) TURRET CLOSURE ASSEMBLY

(71) Applicant: Tessy Plastics Corporation, Elbridge, NY (US)

(72) Inventors: Jim Weishaar, Canandaigua, NY (US); Mark Bartlett, North East, PA (US)

(73) Assignee: Tessy Plastics Corporation, Skaneateles, NY (US)

( * ) Notice: Subject to any disclaimer, the term of this patent is extended or adjusted under 35 U.S.C. 154(b) by 59 days.

(21) Appl. No.: 16/788,372

(22) Filed: Feb. 12, 2020

(65) Prior Publication Data

US 2020/0255193 A1 Aug. 13, 2020

Related U.S. Application Data

(60) Provisional application No. 62/804,330, filed on Feb. 12, 2019.

(51) Int. Cl.

| | |
|---|---|
| ***B65D 47/06*** | (2006.01) |
| ***B65D 47/20*** | (2006.01) |
| ***B65D 47/08*** | (2006.01) |
| ***B65D 47/30*** | (2006.01) |

(52) U.S. Cl.

CPC ..... *B65D 47/066* (2013.01); *B65D 47/08* (2013.01); *B65D 47/2006* (2013.01); *B65D 47/305* (2013.01)

(58) Field of Classification Search

CPC .. B65D 47/066; B65D 47/08; B65D 47/2006; B65D 47/305; B65D 47/065

USPC ..... 222/533

See application file for complete search history.

(56) References Cited

U.S. PATENT DOCUMENTS

| | | | | |
|---|---|---|---|---|
| 3,718,238 A * | 2/1973 | Hazard | B65D 47/305 | 222/536 |
| 3,884,392 A * | 5/1975 | Hazard | B65D 47/305 | 222/534 |
| 4,440,327 A * | 4/1984 | Dark | B65D 47/066 | 222/530 |
| 4,860,934 A * | 8/1989 | Komischke | B65D 47/066 | 222/536 |
| 5,332,131 A * | 7/1994 | Pehr | B65D 47/2006 | 222/536 |
| 5,392,968 A * | 2/1995 | Dark | B65D 47/066 | 222/536 |
| 5,542,585 A * | 8/1996 | Peters | B65D 47/305 | D9/542 |
| 5,884,793 A * | 3/1999 | Wang | B65D 47/066 | 220/255 |

(Continued)

*Primary Examiner* — Benjamin R Shaw
(74) *Attorney, Agent, or Firm* — Barclay Damon LLP

(57) ABSTRACT

A closure assembly for a dispenser container comprises a base defining a longitudinal recess and a body configured to be moveably coupled to the base. The base comprises a first seal positioned at a first end of the recess and a second seal positioned at an opposing second end of the recess. The body comprises a first body end and an opposing second body end. A shaft extends from the first body end to the second body end. The body is configured to move between an open position where the body is fluidly connected with the recess, and a closed position where the body engages the first seal and the second seal. The first seal and the second seal are configured to exert a force toward each other in a direction along a longitudinal axis of the body to tension the body.

9 Claims, 9 Drawing Sheets

(56) References Cited

U.S. PATENT DOCUMENTS

| | | | | | |
|---|---|---|---|---|---|
| 5,908,126 | A * | 6/1999 | Wang | B65D 47/305 | 220/837 |
| 6,116,458 | A * | 9/2000 | Dark | B65D 77/283 | 220/709 |
| 6,119,898 | A * | 9/2000 | Dark | B65D 47/066 | 222/536 |
| 6,330,959 | B1 * | 12/2001 | Dark | B65D 47/243 | 222/536 |
| 6,390,341 | B1 * | 5/2002 | Ohmi | B65D 47/305 | 222/536 |
| 2008/0272122 | A1 * | 11/2008 | Son | B65D 47/32 | 215/387 |
| 2012/0305559 | A1 * | 12/2012 | Steininger | B65D 47/0885 | 220/259.2 |
| 2015/0069079 | A1 * | 3/2015 | Son | B65D 51/16 | 220/825 |
| 2017/0341828 | A1 * | 11/2017 | Balkus | B65D 41/04 | |

* cited by examiner

TURRET CLOSURE ASSEMBLY

CROSS REFERENCE TO RELATED APPLICATION

This application is a non-provisional of, and claims the priority and benefit of, U.S. Provisional Patent Application 62/804,330, filed on Feb. 12, 2019, and entitled TURRET CLOSURE ASSEMBLY. The entire contents of said application is hereby incorporated by reference.

TECHNICAL FIELD

This application is generally directed to the field of closures for dispensing containers or receptacles and more specifically to a turret closure assembly configured to seal at opposing ends of the turret when the turret closure assembly is in the closed position, and being comprised completely of components made of the same type of recyclable material such that it is easy and also cost-effective to recycle.

BACKGROUND

Many products are contained in packaging consisting of a bottle or other receptacle that has a closure which allows for a sealed or closed position and a dispensing or open position. One example of such a closure is a flip top lid. End manufacturers use high speed bottling machines to fill the receptacles with a product and then install the closure. Such closures work well when the product is being used by the consumer, however they are weak and prone to damage and destruction during the course of shipping. Shipping exposes the closure to conditions that cause damage to the closure as well as leakage and contamination of the product. For example, exposure to temperature extremes, sharp impacts due to dropping, falling, or other collisions that occur during shipping, as well as changes in pressure all act to weaken and breach the integrity of the closure.

A damaged closure prevents the sale of that unit of product in addition to allowing leakage of product from the packaging. This results in lost profits due to the decrease in the number of units of product that can be sold to consumers as well as the cost spent to clean up spilled product.

Manufacturers have attempted to solve this problem by producing more robust closures as well as producing closures that allow for a separate shipping mode which makes the closure more resistant to leakage in the case damage. However, these closures require the separate installation of multiple pieces on the receptacle. Other attempts include the installation of a separate seal over the opening of the receptacle before the closure is attached. These methods increase manufacturing costs, which in turn increase the final price to the consumer. Moreover, these closures and additional sealing steps are not compatible with the existing machinery used to install closures on receptacles or are not capable of withstanding the pressure in which the existing machinery installs said closures.

The foregoing background describes some, but not necessarily all, of the problems, disadvantages and shortcomings related to current closure assemblies used in dispensing containers.

SUMMARY

An embodiment of a closure assembly for a dispenser comprises a base and a body. The base comprises a top surface defining a recess, a first seal positioned at one end of the recess, and a second seal positioned at an opposing end of the recess. The body comprises a first end defining a first opening and an opposing second end defining a second opening. The body defines an interior space extending from the first opening to the second opening. The second end of the body is configured to be pivotally coupled to the top surface. The body is configured to move between an open position where the body is fluidly connected with the recess, and a closed position where the body is not fluidly connected with the recess. In the closed position, the first seal engages the first end of the body to create a water-tight seal and the second seal engages the second end of the body to create a water-tight seal. The first seal and the second seal are configured to exert a force toward each other in a direction along a longitudinal axis of the tube to tension the body.

Another embodiment of a closure assembly for a dispenser container comprises a base defining a longitudinal recess and a body configured to be moveably coupled to the base. The base comprises a first seal positioned at a first end of the recess, and a second seal positioned at an opposing second end of the recess. The body comprises a first body end and an opposing second body end. The body defines a shaft extending from the first body end to the second body end. The body is configured to move between an open position where the body is fluidly connected with the recess, and a closed position where the body engages the first seal and the second seal and is tensioned between the first seal and the second seal.

An embodiment of a method of manufacturing a closure assembly for a dispensing container comprises molding a base defining a recess. The base comprises a first seal positioned at a first end of the recess and a second seal positioned at an opposing second end of the recess. Molding a body configured to be moveably coupled to the base. The body comprises a first body end, an opposing second body end, and an interior body surface defining a shaft extending from the first body end to the second body end. The body is configured to move between an open position where the body is fluidly connected with the recess, and a closed position where the body engages the first seal and the second seal and is tensioned between the first seal and the second seal.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

The following discussion relates to various embodiments of a turret closure assembly for a dispensing container or receptacle. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. The terms "about" or "approximately" as used herein may refer to a range of 80%-125% of the claimed or disclosed value. With regard to the drawings, their purpose is to depict salient features of the turret closure assembly and are not specifically provided to scale.

Figure 1:
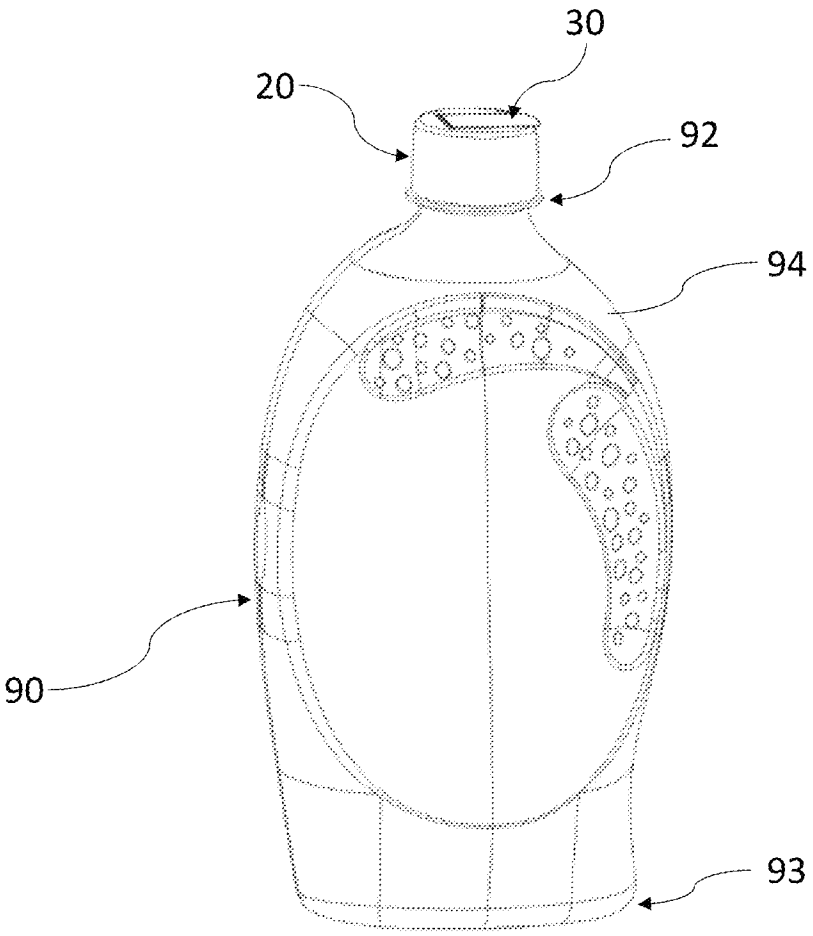
FIG. 1 illustrates a top perspective view of an embodiment of a turret closure assembly installed onto a receptacle and in a closed position.
Figure 2:
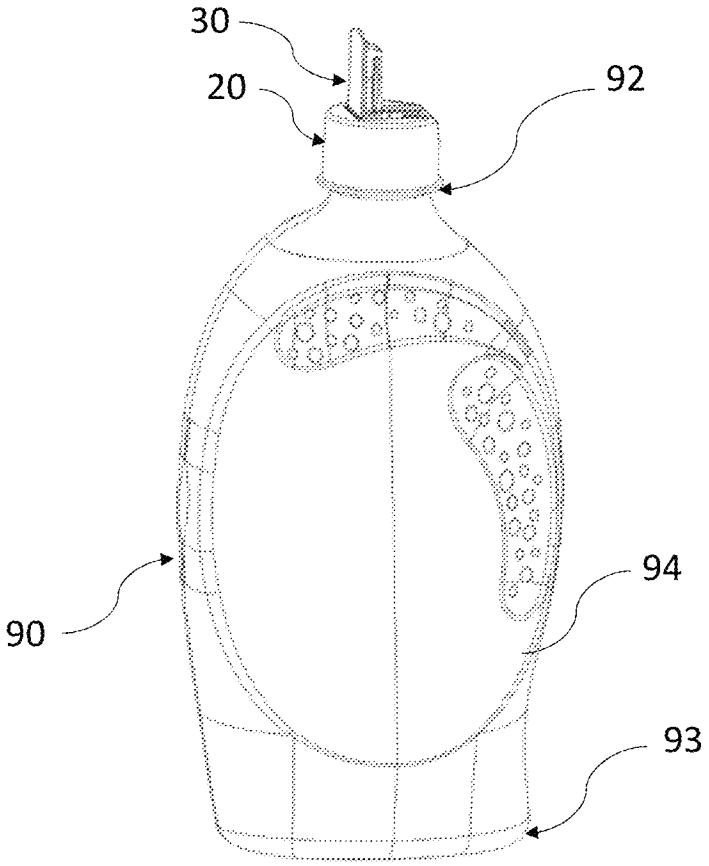
FIG. 2 illustrates a top perspective view of an embodiment of the turret closure assembly installed onto a receptacle and in an open position.
Figure 3:
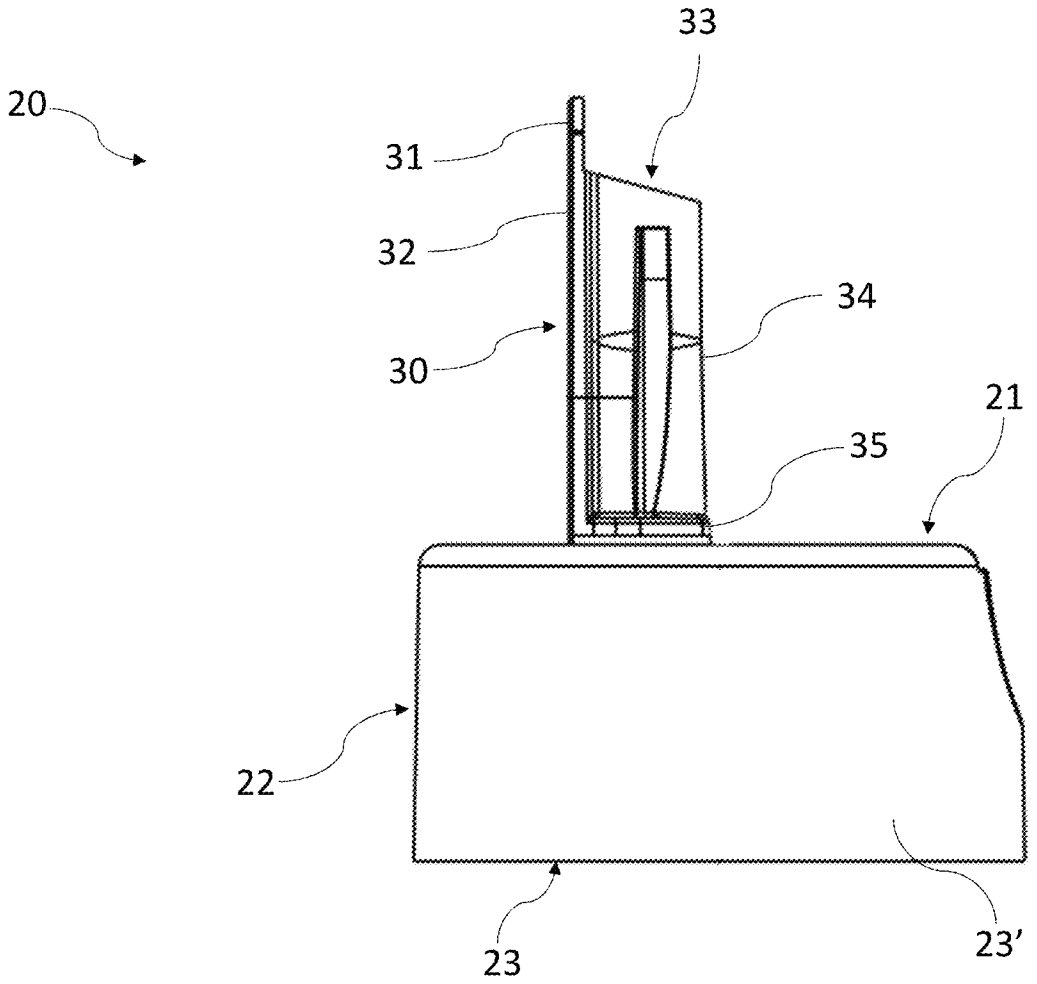
FIG. 3 illustrates a side plan view of an embodiment of the turret closure assembly in the open position.
Figure 4:
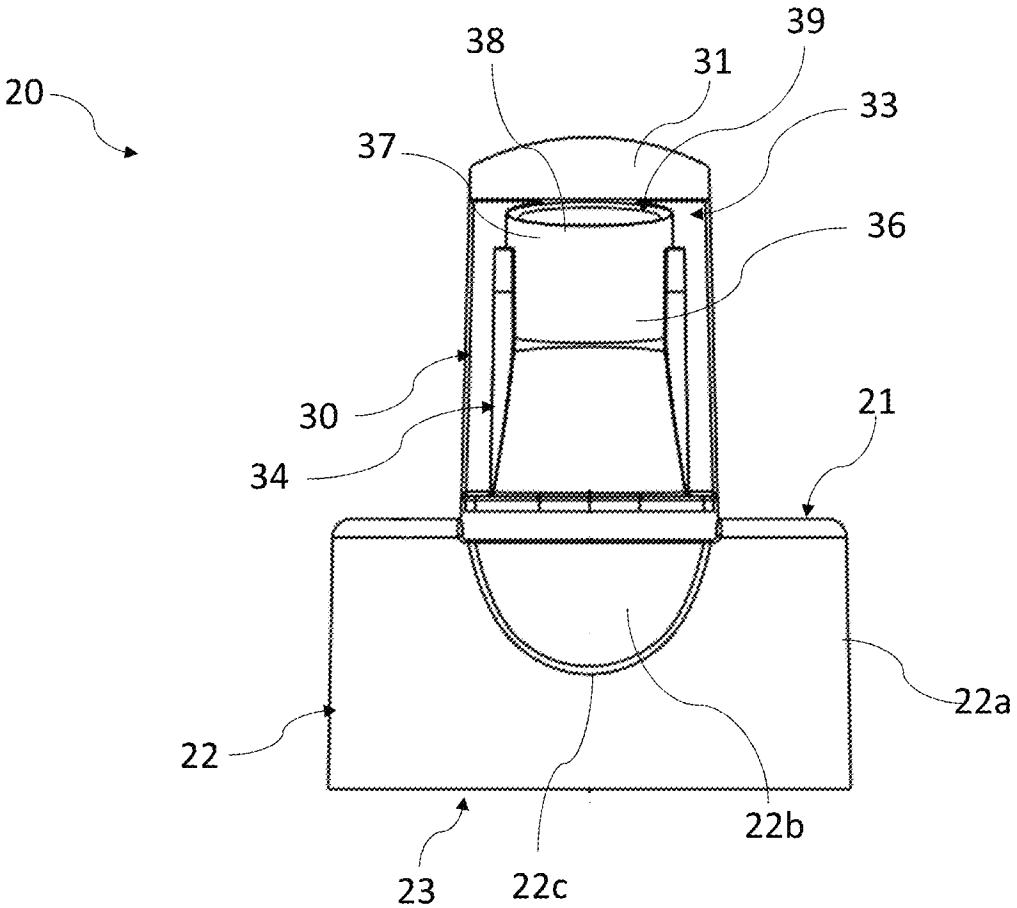
FIG. 4 illustrates a front plan view of an embodiment of the turret closure assembly in the open position.
Figure 5:
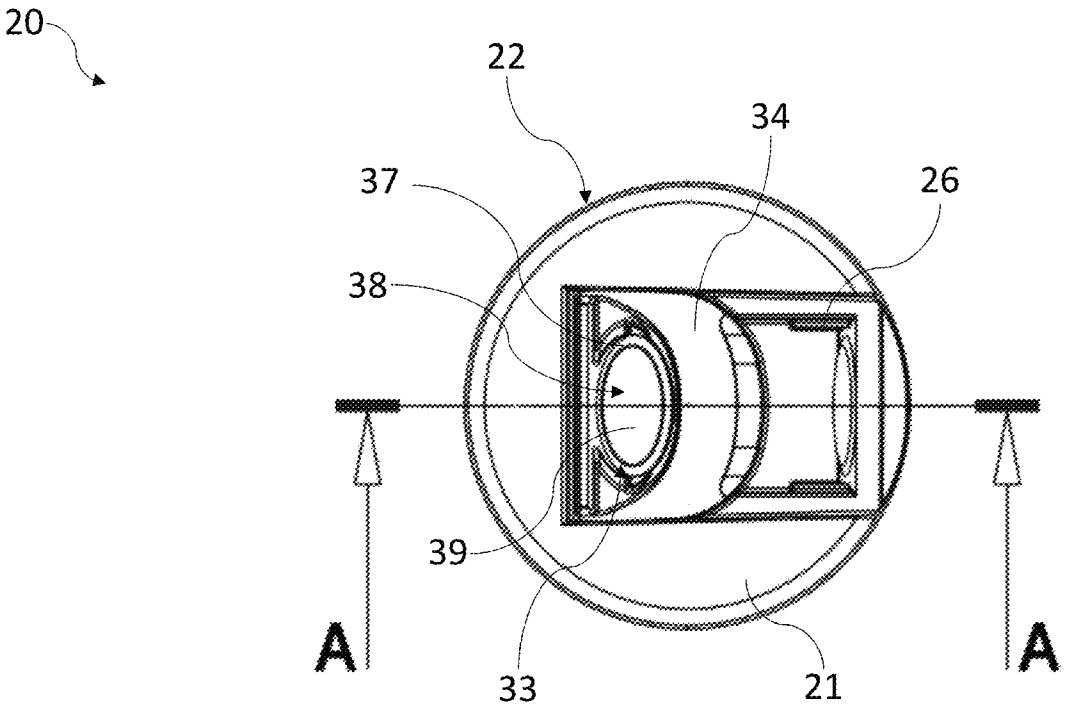
FIG. 5 illustrates a top plan view of an embodiment of the turret closure assembly in the open position.

Referring to FIGS. 1-2, a turret closure assembly 20 is configured to be installed onto a dispensing container or receptacle 90. As shown in FIGS. 1 and 2, the receptacle 90 comprises a top end 92, and opposing bottom end 93 and an exterior surface 94. In the embodiments shown, the turret closure 20 is installed at the top end 92 of the receptacle 90, however in other embodiments, the turret closure may be installed at a different end. FIG. 1 depicts the turret closure assembly 20 in a closed position such that the contents of the receptacle 90 cannot be dispensed through the turret closure assembly 20. In contrast FIG. 2 depicts the turret closure assembly 20 in an open position such that the contents of the receptacle 90 may be dispensed through the turret closure assembly 20.

Figure 6:
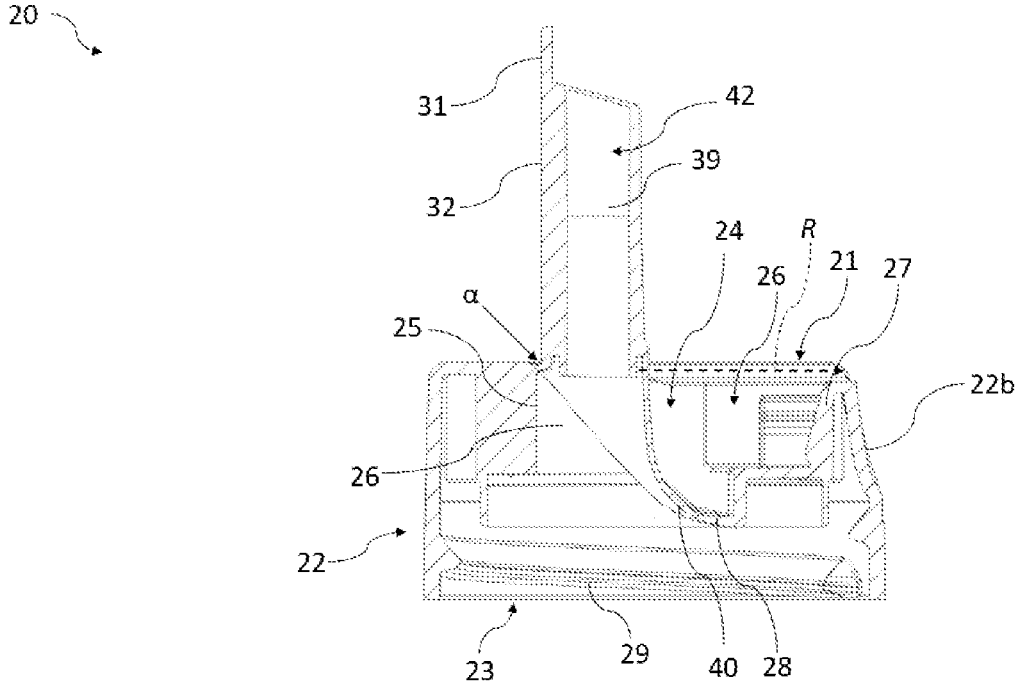
FIG. 6 illustrates a cross sectional view of the embodiment of the turret closure assembly of FIG. 5 along axis A-A.
Figure 6A:
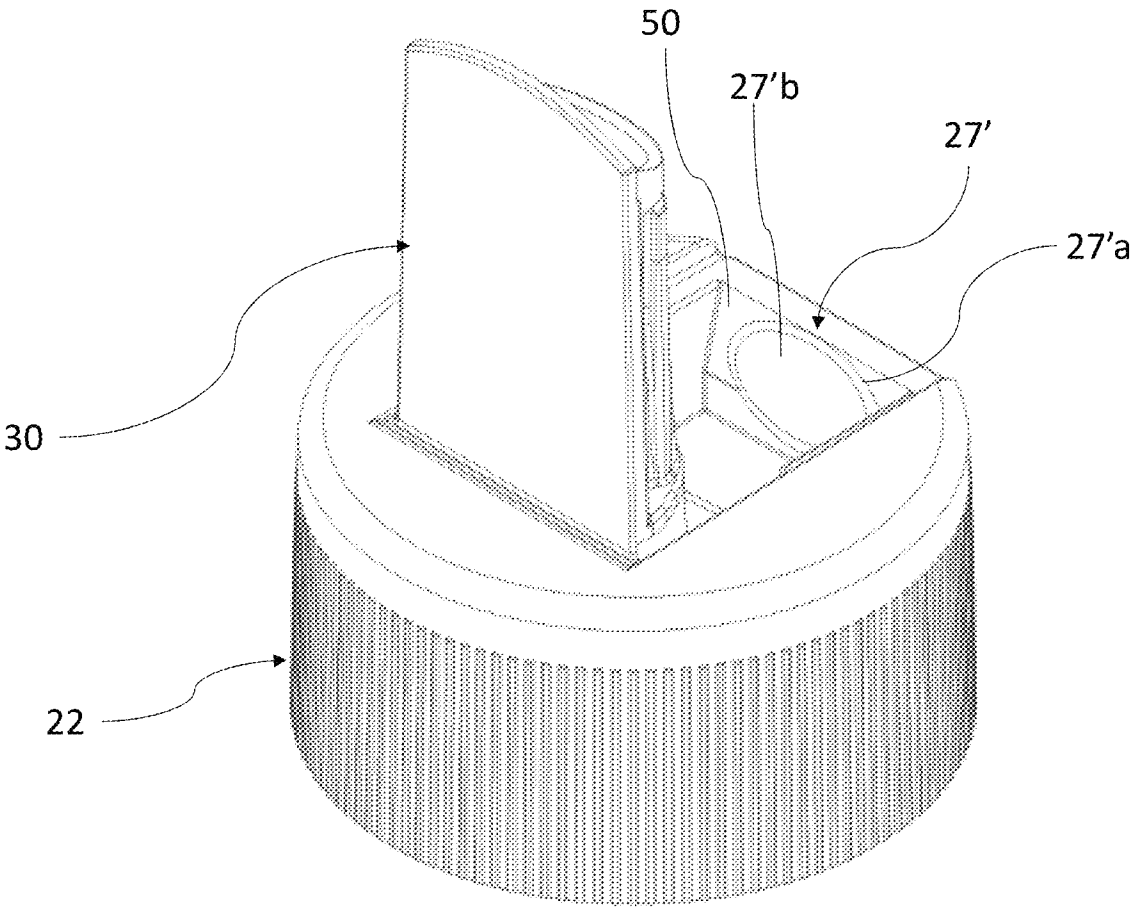
FIG. 6A illustrates a top perspective view of an embodiment of the turret closure assembly in the open position.

Referring to FIGS. 3-6A, the turret closure assembly 20 generally comprises a cylindrical base 22 defining an interior space 24 and a turret 30 that is pivotally coupled to the base 22. The base 22 has at top surface 21, a bottom 23, and a circumferential wall 22*a* (FIGS. 3-4) that defines a depression 22*b* bounded by a shoulder 22*c*, denoting the front of the turret closure assembly 20. As shown, the top surface 21 of the base 22 defines a recess 26 that extends a length greater than the radius R of the top surface 21. In another embodiment, the recess 26 may extend a length that is less than the radius of the top surface 21. The end of the recess 26 proximate the depression 22*b* is considered the front end and comprises a first seal, or a dispensing end seal 27. The opposing back end of the recess 26 comprises a second seal or base engagement end seal 25. As shown, the base engagement end seal 25 and the dispensing end seal 27 may comprise a hemispherical in shape or a partially hemispherical shape as is shown in FIG. 6A, however in other embodiments the base engagement end seal 25 and/or the dispensing end seal 27 may have a different shape, such as a substantially planar shape. Referring specifically to FIG. 6A, an embodiment of the dispensing end seal 27' comprises a generally round perimeter 27'*a* that protrudes from an inner wall 50 of the cylindrical base 22. As shown, the round perimeter 27'*a* may comprise a partially hemispherical shape. A plug 27'*b* is positioned adjacent to the perimeter 27'*a* and may comprise a dome-shape, a planar shape, or any other shape necessary for sealing an end of the turret 30. The dispensing end seal 27, 27' and/or the base engagement end seal 25 may be formed with the base 22 as a single unitary component. In other embodiment, the dispensing end seal 27, 27' and or the base engagement end seal 25 may be a separate component that is coupled to the base 22 using an adhesive, a fastener, or any other means to couple the dispensing seal 27, 27' and/or the base engagement end seal 25 to the base 22.

A turret stop 28 at least partially extends into the interior space 24 from the recess 26 towards the bottom 23 of the base 22. The interior of the base 22 may comprise one or more engagement features 29 configured to interact with complimentary engagement features on an outside surface 94 of the receptacle 90 in order to removably couple the turret closure assembly 20 to the receptacle 90. As shown, the one or more engagement features 29 of the base 22 comprise one or more threads or annular grooves.

Figure 7:
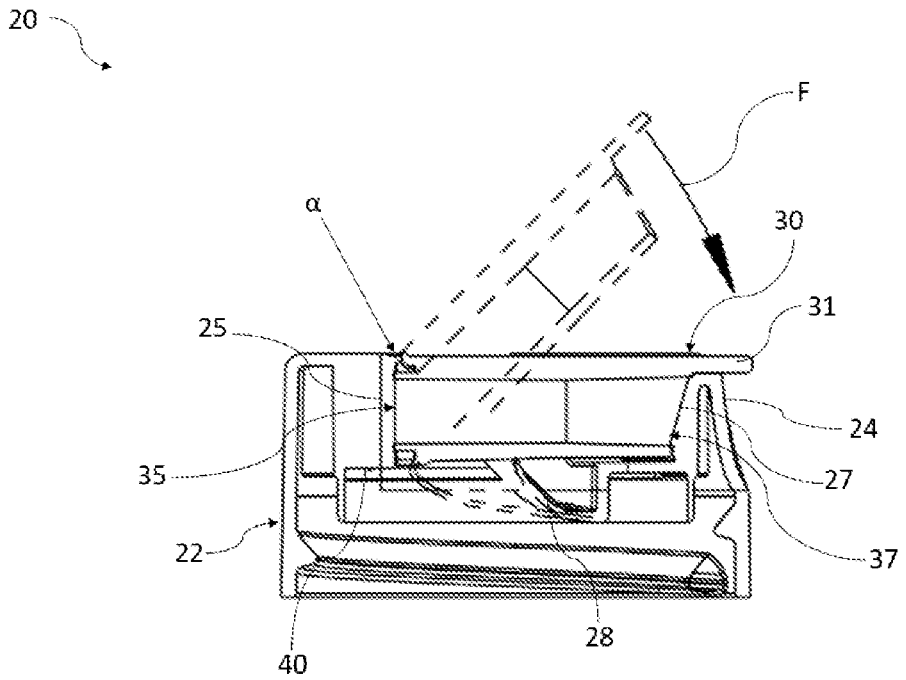
FIG. 7 illustrates a cross sectional view of an embodiment of the turret closure assembly in the closed position.

Still referring to FIGS. 3-6, the turret 30 is pivotally coupled at one end to the base 22 and is configured to pivot about a pivot point a to define an open position as shown or a closed position (FIGS. 1, and 7-8) by moving the turret 30 in a direction F (FIG. 7). In an embodiment, the turret 30 may be coupled to the base 22 using a snap-fit engagement of complimentary components, an axle extending through at least part of the turret 30 and being anchored or couple to the base 22 at each end, or any other suitable means of pivotally coupling the turret 30 to the base 22. The turret 30 generally comprises a tubular body 34 and a finger engagement surface 32. As shown, the body 34 comprises an exterior surface 36 and an interior surface 39 defining an interior space 42. The body 34 extends from the dispensing end 33 to the base engagement end 35 of the turret 30. The dispensing end defines an opening 38 into an interior space 42 of the body 34. In an embodiment, the dispensing end may comprise a nozzle 37 that defines the opening 38. The base engagement end 35 comprises a stop engager 40 that is configured to contact the turret stop 28 when the turret 30 is in the open position (FIGS. 2-6A) in order to prevent over pivoting of the turret 30, and to promote proper alignment of the body 34 such that the interior space 42 of the body 34 is fluidly connected with an interior of the receptacle 90.

Figure 8:
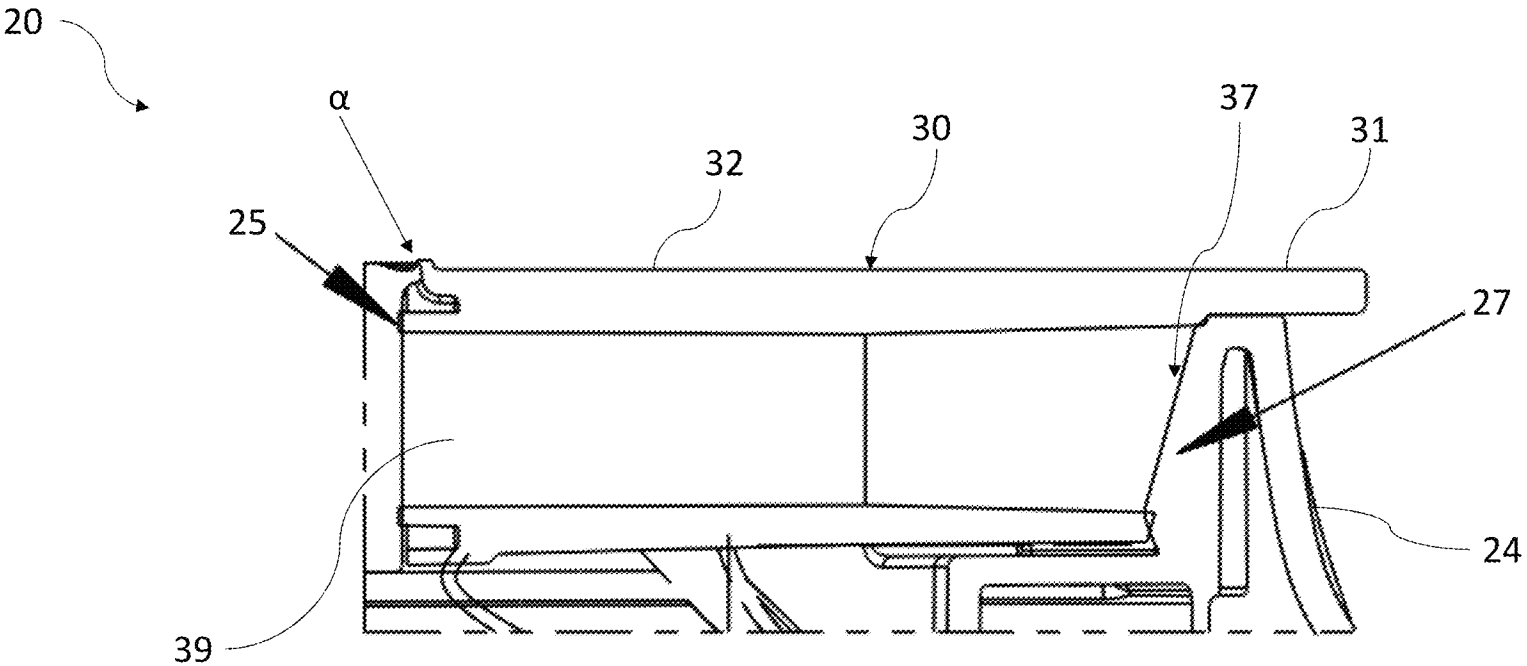
FIG. 8 illustrates a cross sectional view of an embodiment of the turret closure assembly in the closed position.

The finger engagement surface 32 is positioned on one side of the body 34 and extends past the opening 38 to form a lip 31. In the embodiments shown, the finger engagement surface 32 is planar. Referring to FIGS. 7-8, the turret 30 is shown in the closed position such that the finger engagement surface 32 is flush with the top surface 21 and the lip 31 extends beyond the depression 22*b*. FIG. 7 indicates in phantom the turret 30 in a partially open position as it is moves to the fully closed position (or the fully open position). To open the turret closure 20, the lip 31 is pushed up and away from the top surface 21 of the base 22 and the turret 30 is pivoted until resistance is felt due to contact with the turret stop 28. As shown, the turret 30 is positioned at a about a 90° angle relative to the top surface 21 when in the fully open position. In an embodiment, the turret 30 may lock into place once it is in the fully opened position such that an increased amount of force in the direction F (FIG. 7) is required to disengage the lock in order to pivot the turret 30 into the closed position (FIGS. 1, and 7-8).

Still referring to FIGS. 7-8 showing the turret closure assembly 20 in the closed position, the base engagement end seal 25 is at least partially positioned within the interior space 42 of the base engagement end 35 and the dispensing end seal 27 is at least partially located within the interior space 42 of the dispensing end 33. The dispensing end 33 of the body 34 may curve or be angled with respect to the finger engagement surface 32 toward an opposing end of the body 34. As shown in FIGS. 3, and 6-8, the dispensing end 33 of the body 34 is positioned at an obtuse angle relative to the finger engagement surface 32. The curved or angled shape of the dispensing end 33 is configured to facilitate a water-tight seal between the opening 38 at the dispensing end 33 and the dispensing end seal 27. As similar curve or angle may exist at the base engagement end 35 and may be configured to facilitate a water-tight seal between the opening defined at the base engagement end 35 and the base engagement end seal 25.

In the closed position, the base engagement end seal 25 and the dispensing end seal 27 are configured to exert a force towards each other in a direction along the longitudinal axis of the body such that the body 34 is tensioned between the base engagement seal 25 and the end seal 27. Tensioning of the body 34 acts to maintain the water-tight seals at each end 35, 33 and to prevent unintentional disengagement of the base engagement end seal 25 and the dispensing end seal 27 from the base engagement end 35 and the dispensing end 33, respectively. In this manner, the turret closure assembly 20 is much less likely to leak, inadvertently open, or break during shipping.

One or more components of the turret closure assembly 20 may be manufactured using injection molding. The components of the turret closure assembly 20 are manufactured from the same recyclable material, such as polyolefin, or another same type of recyclable material. As referred to herein, the same type of recyclable material refers to material that can be recycled in the same manner or using the same processes, or otherwise does not need to be sorted out or undergo additional processing in order to properly recycle. The same type of recyclable material would also encompass materials that are assigned the same recycling code. The turret closure assembly 20 as described above is made of the same type of recyclable material such that it may be recycled while in the assembled state as shown in FIGS. 1-8.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follows, they are used only in a generic and descriptive sense, and not for the purposes of limiting the present disclosure, nor the claims which follow.

The invention claimed is:

1. A closure assembly for a dispenser comprising:
- a base comprising,
  - a top surface defining a recess,
  - a first seal positioned at one end of the recess,
  - a stop member positioned in the recess, and
  - a second seal positioned at an opposing end of the recess; and
- a body comprising,
  - a first end defining a first opening,
  - an opposing second end defining a second opening, and
  - a stop engager, wherein the body defines an interior space extending from the first opening to the second opening, the second end of the body is configured to be pivotally coupled to the top surface,
- wherein the body is configured to move between an open positon where the body is fluidly connected with the recess, and a closed position where the body is not fluidly connected with the recess,
- wherein the stop engager is configured to contact the stop member when the body is in the open position,
- wherein in the closed position, the first seal engages the first end of the body to create a water-tight seal and the second seal engages the second end of the body to create a water-tight seal, and wherein the first seal and the second seal are configured to exert a force toward each other in a direction along a longitudinal axis of the body to tension the body.

2. The closure assembly of claim 1, further comprising a lip formed on the body that extends beyond the first end of the body.

3. The closure assembly of claim 1, wherein the stop member is positioned between the first seal and a bottom of the base.

4. The closure assembly of claim 1, wherein at least one of the first seal and the second seal comprise a partially hemispherical shape.

5. The closure assembly of claim 1, wherein a force required to move the body between the open position and the closed position is greater than a force required to move the body between the closed position and the open position.

6. A closure assembly for a dispenser container, comprising:
- a base defining a longitudinal recess and comprising,
  - a first seal positioned at a first end of the recess,
  - a second seal positioned at an opposing second end of the recess,
  - a stop member positioned at least partially within the recess; and
- a body configured to be moveably coupled to the base, the body comprising,
  - a first body end,
  - an opposing second body end,
  - a shaft extending from the first body end to the opposing second body end, and
  - a stop engager, wherein the body is configured to move between an open position where the body is fluidly connected with the recess, and a closed position where the body engages the first seal and the second seal and is tensioned between the first seal and the second seal, and wherein the stop engager is configured to contact the stop member when the body is in the open position.

7. The closure assembly of claim 6, further comprising a lip formed on the body that extends beyond the first end of the body.

8. The closure assembly of claim 6, wherein the stop member is positioned between the first seal and a bottom of the base.

9. The closure assembly of claim 6, wherein at least one of the first seal and the second seal comprise a partially hemispherical shape.

* * * * *